US005437395A

United States Patent [19]

Bull et al.

[11] Patent Number: 5,437,395

[45] Date of Patent: Aug. 1, 1995

[54] MODULAR BEVERAGE DISPENSER

[75] Inventors: Ronald E. Bull; Harlan R. Davis, both of Mason City, Iowa

[73] Assignee: IMI Cornelius Inc., Anoka, Minn.

[21] Appl. No.: 946,053

[22] Filed: Sep. 15, 1992

[51] Int. Cl.[6] ..... B67D 5/56; B67D 5/62

[52] U.S. Cl. ..... 222/129.1; 222/146.6

[58] Field of Search ..... 222/129.1, 129.2, 129.3, 222/129.4, 146.6

[56] References Cited

U.S. PATENT DOCUMENTS

| | | | |
|---|---|---|---|
| 4,592,490 | 6/1986 | McMichael | 222/129.1 |
| 4,781,309 | 11/1988 | Vogel | 222/129.1 |
| 4,913,183 | 4/1990 | Vogel et al. | 222/129.1 |
| 4,969,576 | 11/1990 | Merrill et al. | 222/129.4 |

*Primary Examiner*—Andres Kashnikow
*Assistant Examiner*—Lesley D. Morris
*Attorney, Agent, or Firm*—Sten Erik Hakanson

[57] ABSTRACT

The present invention shows a beverage dispenser of the type utilizing a tower standing above a counter top surface. A plurality of beverage supply lines are connected to a mounting block secured to a top surface of the counter top. The mounting block includes a plurality of receptacles providing releasable securing of a plurality of beverage line modules thereto. The beverage line modules are retained within the tower and each include an insulation block formed around a pair of beverage lines. The beverage lines terminate on one end thereof with valve receptacle ends for connecting to a plurality of dispensing valves, and on opposite ends with plugs for releasable insertion into the receptacles. The modules can be conformed to provide for beverage dispensers of varying numbers of beverage valves wherein the number of valves is equal to or less than a number of receptacles in the mounting block.

25 Claims, 4 Drawing Sheets

MODULAR BEVERAGE DISPENSER

FIELD OF THE INVENTION

The present invention relates generally to post-mix beverage dispensing apparatus, and, in particular, to such apparatus having a beverage dispensing tower.

BACKGROUND

BACKGROUND OF THE INVENTION

Beverage dispensers are known that incorporate a tower structure which extends upwardly above a counter top surface and is connected to a plurality of beverage lines emanating from a beverage line cooling source, such as a cold plate. A tower is typically made of a stainless steel wrap and includes a plurality of beverage valves connected to a front face surface thereof.

Such beverage dispensers can be manufactured with any of a plurality of valves, typically between four and eight such valves. Heretofore, each tower type beverage dispenser is manufactured to the particular number of valves required. Unfortunately, such beverage dispensing units have very little in the way of interchangeable parts, save for the beverage dispensing valves themselves. Thus, a five valve unit is uniquely manufactured and shares very few parts in common with the six-valve unit. In particular, the specific and significant parts such as the cold plate and the tower have to be uniquely and individually designed for that particular number of desired valves. In addition, there exists a substantial problem with heat loss and leakage associated with the portion of the beverage lines that extend within the tower, especially where those line are plastic tubing. Moreover, current beverage towers involve a substantial amount of labor in their manufacture.

Accordingly, it would be highly desirable to have a beverage dispensing device wherein, greater part interchangeability is provided for, and wherein the performance thereof and ease of manufacture are enhanced.

SUMMARY OF THE INVENTION

The present invention is a beverage dispenser, of the type using a tower and a cooling means, such as an ice cooled cold plate, wherein modular units are used to provide for a greatly enhanced flexibility in the manufacturing thereof, along with improved performance and greater ease of manufacture.

A cooling means, such as a cold plate, is retained below a counter top surface and includes an ice retaining bin on the top thereof. The cold plate includes a plurality of beverage lines extending in a serpentine fashion therethrough and exiting the cold plate and extending upwardly to a receiving block. The receiving block includes a plurality of female plug receptacle pairs secured therein. The receiving block is in turn secured to the top of the counter surface and each receptacle is fluidly connected to a carbonated water line and a syrup line.

The present invention further includes a plurality of beverage modules consisting of a molded foam insulation formed around a pair of beverage line segments. The beverage lines extend through the insulation from a first beverage valve connecting end to a second end having a male plug secured thereto. A module is provided for each of the plurality of receptacles and can be releasably connected thereto by insertion of the male plug ends into the receptacles. A sheet metal outer housing forming the tower is then secured around the plurality of modules. The beverage valves are then secured to the beverage valve ends of the module tubes as they extend outwardly of a faceplate of the tower housing.

If for example, the number of receptacles in the mounting block is equal to six then up to six beverage valves can be suspended from the tower and supplied with beverage constituents. However, if a five-valve unit is desired, it will be appreciated by those of skill that a pair of receptacles of a receptacle block can be obstructed by insertion therein of solid plugs. Then five modules can be designed to be inserted into the remaining five receptacles wherein the valve attaching ends thereof are distributed evenly along the tower. In particular, a central module can be made as wide as a previous singular module used in a six-valve unit and the beverage tubes in the five modules can be routed through the insulation thereof in such a manner that, then positioned within the tower the valve connecting ends of the modules exit the face of the tower such that when the valves are connected thereto they are distributed evenly along the length of the tower. The double wide module can sit over the unused receptacle block and provide for retaining the blocking plugs therein.

Thus, it can be appreciated, that such a unit will have the flexibility of being manufactured into a four, five or six valve unit without having to change many parts. In particular, the cooling means, such as the cold plate can stay the same, as can the mounting block and the tower sheet metal. All that changes essentially, is the number and structure of the modules, the tower valve face plate, so as to accommodate the various hole patterns, and, of course, the number of dispensing valves. Additionally, such a tower beverage dispenser is easy to manufacture, as the modules provide for a plug-in assembly. Such assembly process is in contrast to the use of plastic tubing within the tower that must be connected by clamps to hose fittings on both ends thereof. Also, the foam insulation provides for better cool drink performance, and the plug-in connections of the stainless steel tubing module segments are less prone to develop leaks over time as has been experienced with plastic tubing.

DESCRIPTION OF THE DRAWINGS

A more thorough understanding of the structure operation and advantages of the present invention can be had by referring to the following detailed description, which refers to the following figures, wherein.

DETAILED DESCRIPTION

Figure 2:
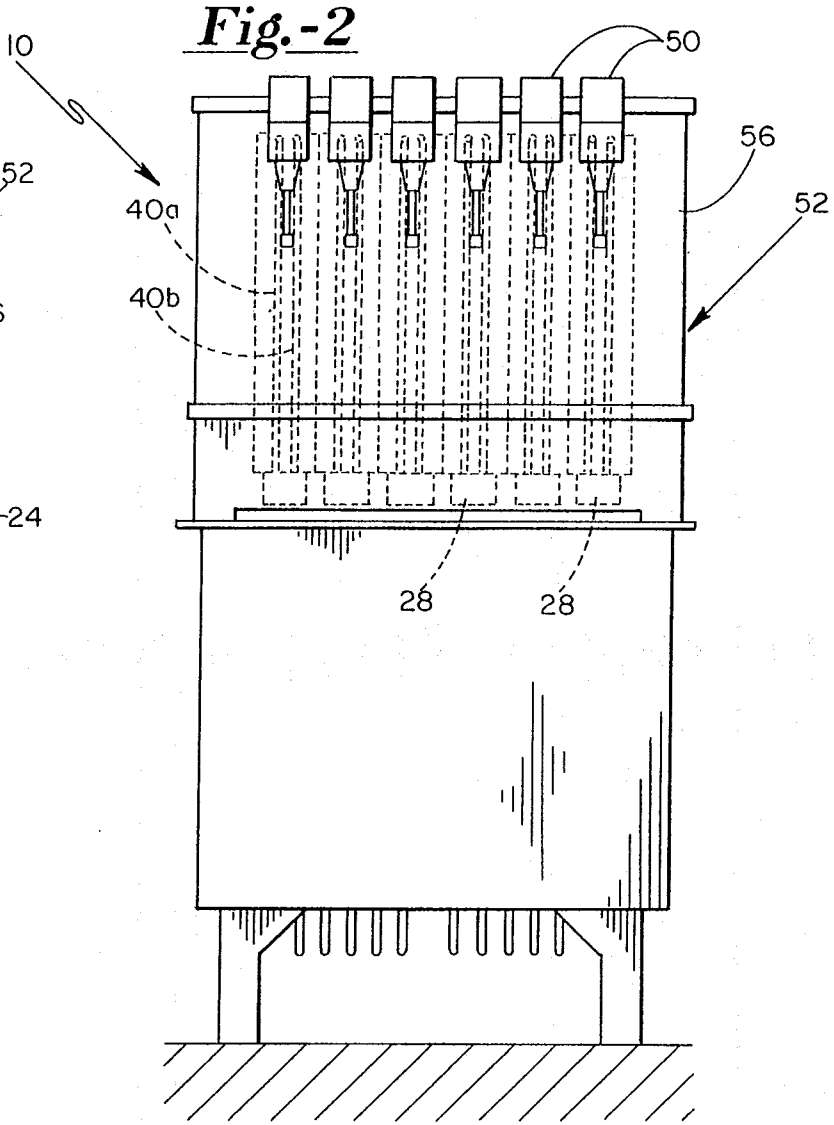
FIG. 2 shows a front plan view of the present invention.
Figure 1:
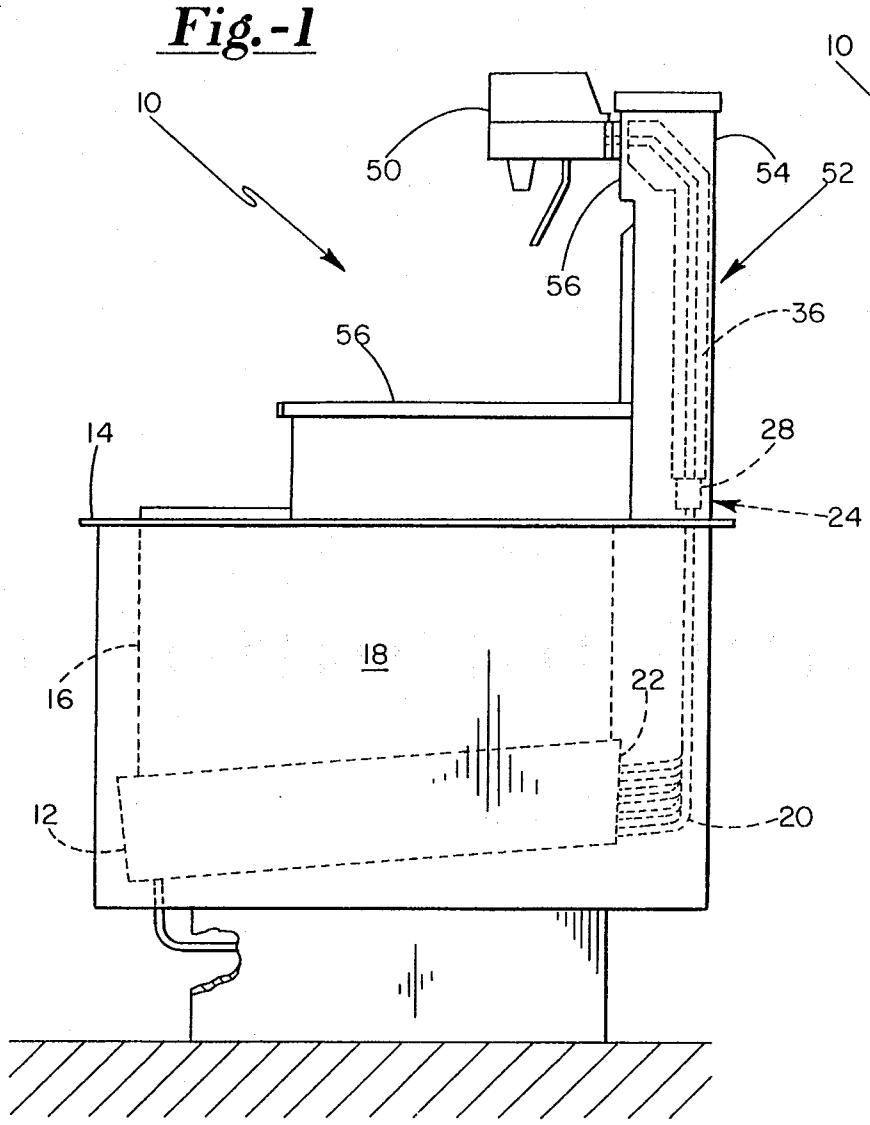
FIG. 1 shows a side plan view of the present invention.
Figure 4:
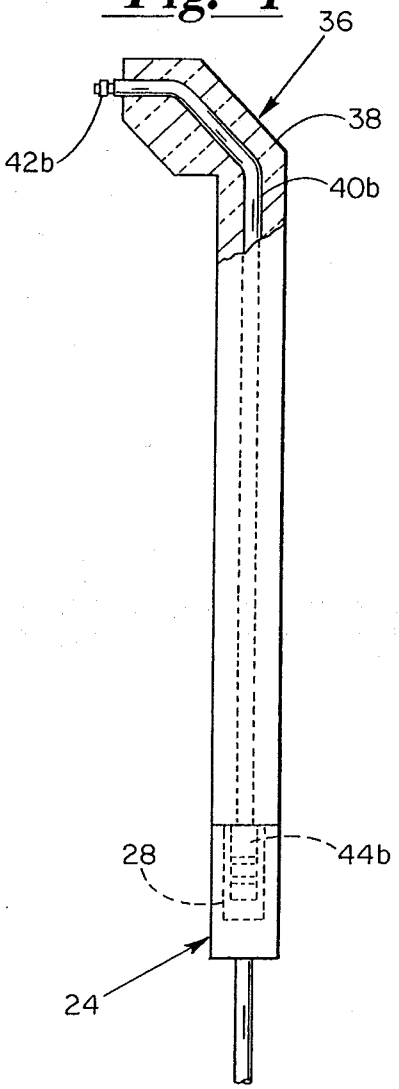
FIG. 4 shows a side plan view of a module and mounting block of the present invention.

The dispenser of the present invention is seen in the various figures and generally referred to by the numeral 10. Dispenser 10 includes a cooling means, such as a cold plate 12 retained below a counter top surface 14. Various other cooling means, such as a refrigerated water bath, could also be used to provide for the cooling of the beverage constituents. Plate 12 includes an ice retaining bin liner 16 secured thereto for creating an ice retaining space 18 for retaining ice therein. As is known in the art, plate 12 includes a plurality of beverage lines 20 extending therethrough in a serpentine fashion and exiting a plate end 22.

Stainless steel lines 20 extend upwardly towards counter top surface 14 and are secured to a mounting block 24. As seen in better detail by referring to FIGS. 3–7, mounting block 24 includes a metal housing 26 for retaining a plurality of receptacle blocks 28. Receptacle blocks 28 each include a pair of bores 30*a* and 30*b* and include tube receiving recesses 32*a* and 32*b*. Receptacles 28 are retained within mounting block 24 and the remainder of the interior space thereof is filled with insulation material 34 such as for example a urethane foam. In the present invention six receptacle blocks 28 are shown, however it will be appreciated by those skilled in the art that any number of blocks could be used. Recesses 32*a* and 32*b* provide for securing of beverage lines 20*a* and 20*b* thereto. It will also be appreciated by those of skill that for typical post-mix beverage dispensing valves, each of the lines 20*a* will carry a beverage constituent such as a syrup, whereas the remaining beverage lines 20*b* will carry a diluent beverage constituent, typically, carbonated water.

Figure 3:
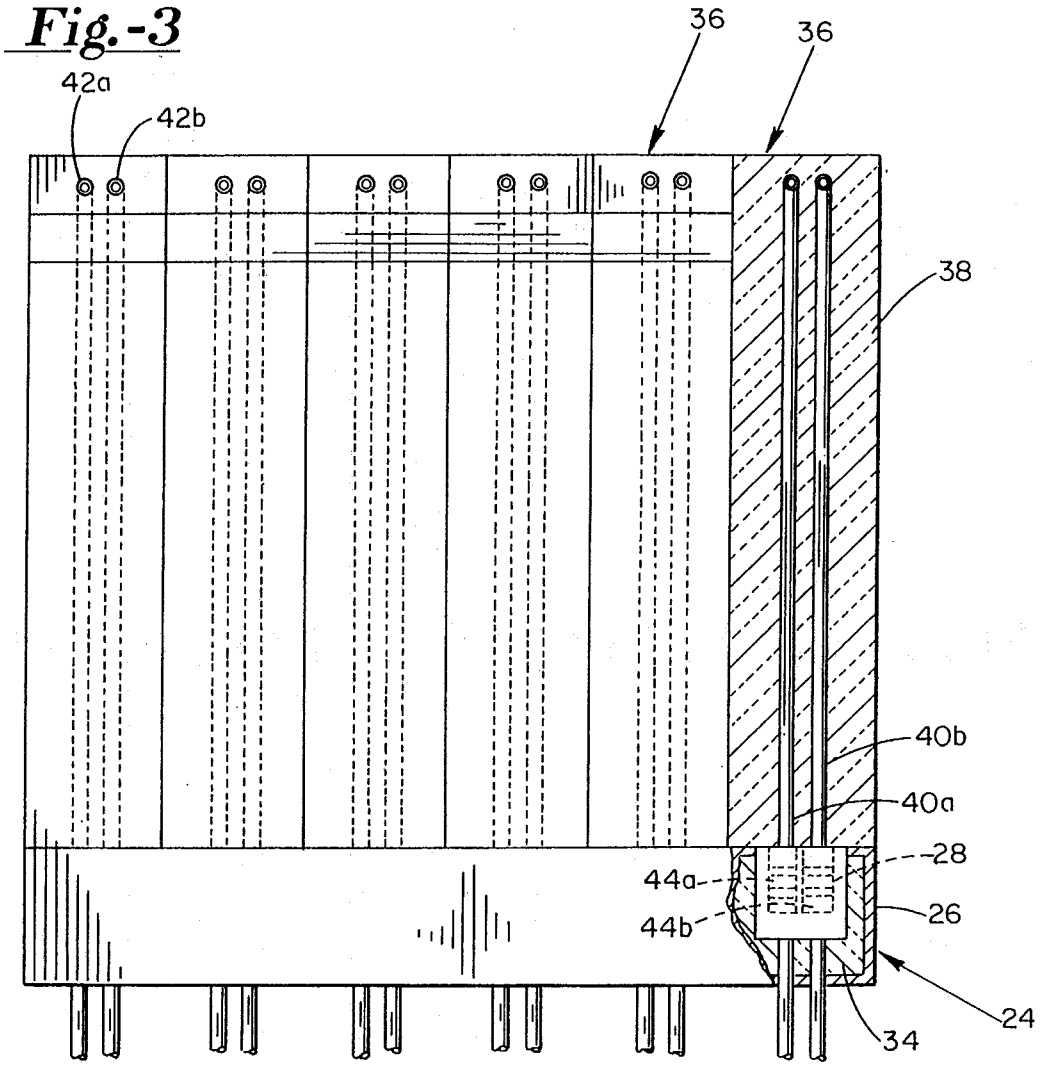
FIG. 3 shows a detailed front plan view of the modules and mounting block of the present invention.
Figure 6:
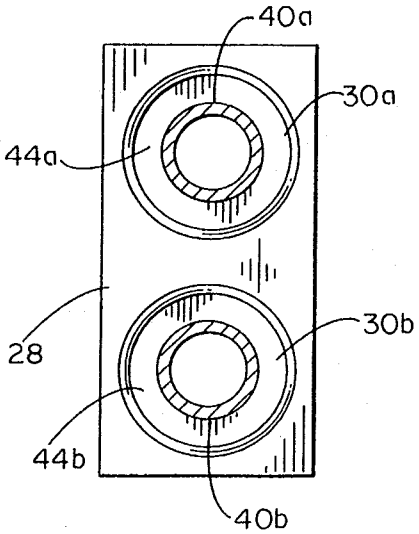
FIG. 6 shows a view along lines 6—6 of FIG. 5.
Figure 5:
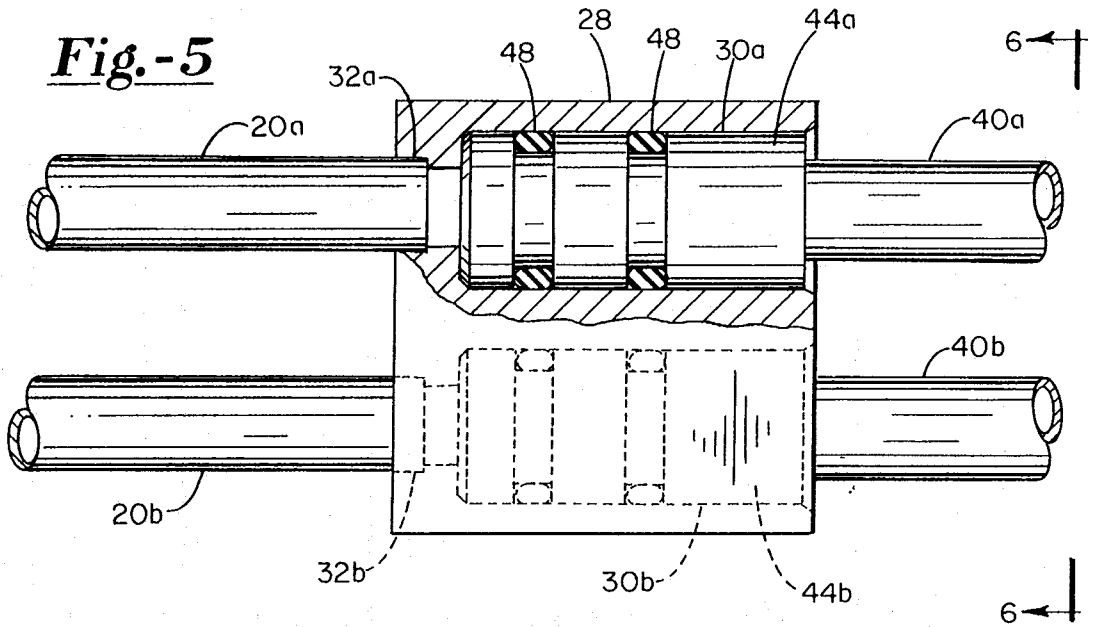
FIG. 5 shows a detailed partial cross-sectional view of a receptacle of the present invention.
Figure 7:
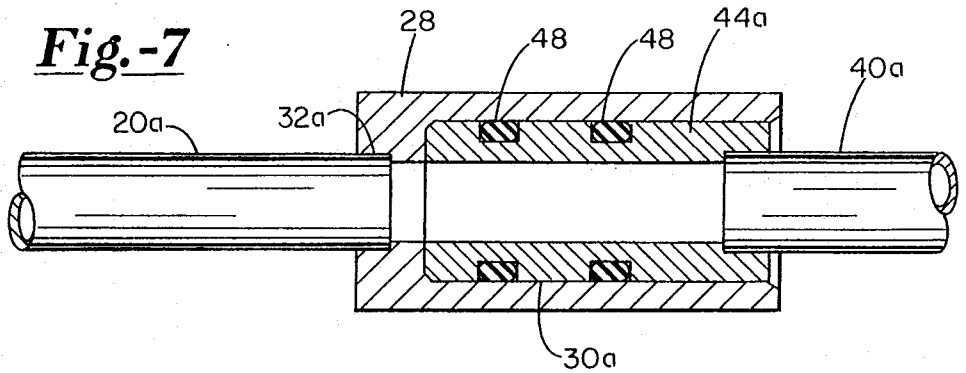
FIG. 7 shows a detailed side cross-sectional view of a receptacle of the present invention.

As seen in FIG. 3 the present invention includes a plurality of insulated beverage line modules 36. Each module 36 is comprised of a formed foam insulation block 38 containing a pair of stainless steel beverage lines 40*a* and 40*b*. Lines 40*a* and 40*b* each include beverage valve connecting ends 42*a* and 42*b* respectively and mounting block connecting end plugs 44*a* and 44*b* respectively. In particular, plugs 44*a* and 44*b* are connected to lines 40*a* and 40*b* and include two recesses containing O-rings 48. Plugs 44*a* and 44*b* are sized to provide for sealing releasable insertion within bores 30*a* and 30*b* respectively, of receptacles 28. Thus, plugs 44*a* and 44*b* provide for fluid continuity from lines 20*a* and 20*b* through lines 40*a* and 40*b* and in turn to a plurality of beverage dispensing valves 50.

A tower 52 having an outer sheet metal housing 54 is secured to counter 14. Tower 52 further includes a faceplate 56 releasably secured to the remainder of housing 54 and includes a plurality of holes, not shown, through which holes tube ends 42*a* and 42*b* extend for connecting to the respective beverage dispensing valve 50. Tower 52 also includes a drip tray 56 which is secured thereto.

The assembly of the present invention can be understood wherein individual modules 36 are inserted into the respective receptacle blocks 28 after which sheet metal housing 54 of tower 52 is secured therearound. Faceplate 56 is then secured to sheet metal housing 54. It can be appreciated by those of skill, that sheet metal faceplate 56 secured to housing 54 combined with the security of housing 54 to counter 14 provides for downward pressure on modules 36 for retaining plugs 44*a* and 44*b* thereof in receptacles 28.

Figure 8:
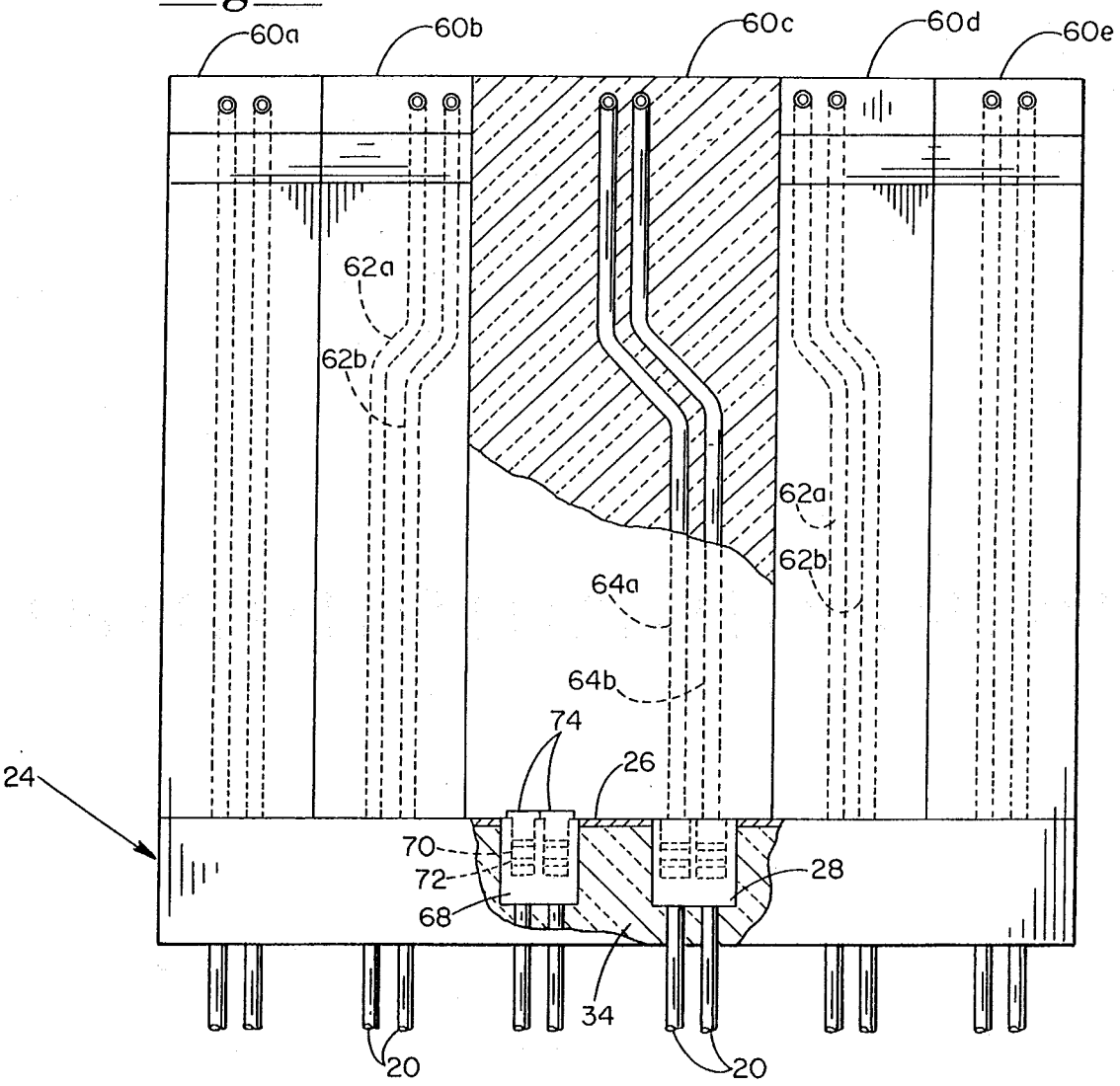
FIG. 8 shows an alternate embodiment of the modules of the present invention.

As seen by referring to FIG. 8, the flexibility of manufacture of the present invention can be appreciated. In particular, the embodiment therein shows a plurality of modified modules 60*a*, 60*b*, 60*c*, 60*d*, and 60*e*. Modules 60*a* and 60*e* are of the same construction as previously described modules 36. Modules 60*b* and 60*d* are the same as modules 36 but for the altered bending or routing of tubes 62*a* and 62*b* therein. Module 60*c* is twice the width of module 60*a* and a single pair of lines 64*a* and 64*b* extend there through so that lines 64*a* and 64*b* terminate essentially centrally thereof. It will be appreciated that modules 60*a* will provide for a version of the present invention having five valves 50. Thus, the extra receptacle marked 68 herein, includes a pair of plugs 70 for insertion therein for blocking the female receptacles thereof. Plugs 70 include o-rings 72 and a cap head 74. Thus, it can be appreciated that the various lines 40*a* and 40*b*, 62*a* and 62*b*, and 64*a* and 64*b* can be routed within the interior of the various modules 60*a* through 60*e* so that they terminate in a manner wherein five valves 50 are distributed evenly across the front of the tower 52. In this manner, a standard cold plate size and coil pack can be used for any of a variety of beverage dispensers. Also, It can be appreciated that the only variation in the manufacture of a particular number valve unit to another concerns the structure of the modules and faceplate of the tower. In addition any number of mounting block sizes could be used. For example, eight receptacle blocks could be provided for thereby allowing the manufacture of a tower having up to eight valves, along with the flexibility to manufacture dispensing units having typically 5 or more valves. Moreover, lines 40*a* and 40*b* and the like, could be wrapped with an insulation rather than contained within a foam bloc, or need not necessarily be insulated.

We claim:

1. A beverage dispenser, comprising:

a lower housing for retaining a cooling means therein, the cooling means for cooling a plurality of beverage constituents flowing through a plurality of beverage delivery lines extending through the cooling means from the first ends thereof for connecting to sources of the beverage constituents to second ends thereof, a dispensing tower, the dispensing tower having an outer housing defining a tower interior, and the tower having a lower end and a top end, the tower top end for supporting a plurality of beverage dispensing valves on a valve retaining housing surface thereof, and the tower lower end for securing to the lower housing, a plurality of beverage line segments extending through the tower interior, each beverage line segment having a first end at the valve retaining housing surface for connecting to one of the plurality of beverage dispensing valves and having a second end, and means for providing releasable fluid connecting between the second ends of the beverage line segments and the second ends of the delivery lines.

2. The beverage dispenser as defined in claim 1, and the means for providing releasable connecting comprising one or more receptacle blocks having plug receiving bores therein and the delivery line second ends each secured to a first end of on of the one or more receptacle blocks for providing sealed fluid securing thereof to a single plug bore, and each segment line second end comprising a plug for providing releasable and fluid sealing insertion thereof into a plug receiving bore.

3. The beverage dispenser as defined in claim 2, and the one or more receptacle blocks secured and positioned at a level substantially equivalent with a level at which the tower lower end is secured to the lower housing.

4. The beverage dispenser as defined in claim 3, and the delivery lines each having an end rigid portion extending from the cooling means and terminating with the second ends thereof and fluidly secured to the one or more receptacle blocks.

5. The beverage dispenser as defined in claim 1, and the means for providing releasable fluid connecting comprising receptacle means having sockets, and the beverage line segments having plug means at their second ends for providing releasable receiving thereof in the receptacle sockets.

6. The beverage dispenser as defined in claim 5, and the receptacle means secured and positioned at a level substantially equivalent with a level at which the tower lower end is secured to the lower housing.

7. The beverage dispenser as defined in claim 1, and the means for providing releasable fluid connecting comprising a plurality of receptacle blocks, each receptacle block having one or more fluid lines secured thereto and one or more releasable connecting means for providing fluid connection to an equal number of beverage line segments.

8. A beverage dispenser, comprising:

a lower housing for retaining a cooling means therein, the cooling means for cooling a plurality of beverage constituents flowing through a plurality of beverage delivery lines extending through the cooling means, a dispensing tower, the dispensing tower having an outer housing defining a tower interior, and the tower having a lower end and a top end, the tower top end for supporting a plurality of beverage dispensing valves on a valve retaining housing surface thereof, and the tower lower end for securing to the lower housing, a plurality of beverage line modules held within the tower interior, each module comprising a block of insulating material having one or more beverage line segments extending therethrough wherein each beverage line segment has a first end positioned at the valve retaining housing surface for connecting to one of the plurality of beverage dispensing valves and a second end, and beverage line receptacle means secured to the lower housing for providing releasable fluid connecting between the second ends of the beverage line segments and the delivery lines.

9. The beverage dispenser as defined in claim 8, and the receptacle means having sockets, and the beverage line segments having plug means at their second ends for providing releasable receiving thereof in the receptacle sockets.

10. The beverage dispenser as defined in claim 9, and the delivery lines each having an end rigid portion extending from the cooling means and fluidly secured to the receptacle means.

11. The beverage dispenser as defied in claim 10, and the receptacle means comprising a plurality of receptacle blocks, each receptacle block having one or more fluid lines secured thereto and one or more connecting means for providing fluid connection to an equal number of beverage line segments.

12. The beverage dispenser as defined in claim 11, and one or more of the modules having stop means for cooperating with the receptacle means for preventing fluid flow therethrough from one or more of the delivery lines, and the number of modules and the number of beverage line segments extending through the modules being variable so that the same receptacle means, delivery lines, lower housing and cooling means can be used to provide cooled beverage to a variable number of beverage valves.

13. The beverage dispenser as defined in claim 11 and the receptacle means secured at a level on the lower housing substantially equivalent with a level at which the tower lower end is secured to the lower housing.

14. The beverage dispenser as defined in claim 8, and the delivery lines each having an end rigid portion extending from the cooling means and fluidly secured to the receptacle means.

15. The beverage dispenser as defined in claim 8, and the receptacle means comprising a plurality of receptacle blocks, each receptacle block having one or more fluid lines secured thereto and one or more connecting means for providing fluid connection to an equal number of beverage line segments.

16. The beverage dispenser as defined in claim 8, and one or more of the modules having stop means for cooperating with the receptacle means for preventing fluid flow therethrough from one or more of the delivery lines, and the number of modules and the number of beverage line segments extending through the modules being variable so that the same receptacle means, delivery lines, lower housing and cooling means can be used to provide cooled beverage to a variable number of beverage valves.

17. The beverage dispenser as defined in claim 8 and the receptacle means secured at a level on the lower housing substantially equivalent with a level at which the tower lower end is secured to the lower housing.

18. A beverage dispenser, comprising:

a lower housing for retaining a cooling means thereto, the cooling means for cooling a plurality of beverage constituents flowing through a plurality of beverage delivery lines entirely through the cooling means, a dispensing tower, the dispensing tower having an outer housing defining a tower interior, and the tower having a lower end and a top end, the tower top end for supporting a plurality of beverage dispensing valves on a valve retaining housing surface thereof, and the tower lower end for securing to a top end of the lower housing, a plurality of beverage line modules held wig the tower interior, each module comprising a block of insulating material having one or more beverage line segments extending therethrough whereto each beverage line segment has a first end positioned at the valve retaining housing surface for connecting to one of the plurality of beverage dispensing valves and a second end positioned at the tower lower end, and beverage line receptacle means secured to the lower housing top end, the delivery lines fluidly secured to the receptacle means, and the beverage line segments second ends and the receptacle means having connecting means for providing releasable fluid securing therebetween when the tower is secured to the lower housing.

19. The beverage dispenser as defined in claim 18, and the connecting means comprising sockets in the receptacle means and plug ends at the beverage line segments second ends for providing releasable receiving thereof in the receptacle sockets.

20. The beverage dispenser as defined in claim 19, and the receptacle means comprising a plurality of receptacle blocks, each receptacle block having one or more fluid lines secured thereto and one or more connecting means for providing fluid connection to an equal number of beverage line segments.

21. The beverage dispenser as defined in claim 20, and the delivery lines each having an end rigid portion extending from the cooling means and fluidly secured to the receptacle means.

22. The beverage dispenser as defined in claim 21, and one or more of the modules having stop means for cooperating with the connecting means of the receptacle means for preventing fluid flow therethrough from one or more of the delivery lines, and the number of modules and the number of beverage line segments extending through the modules being variable so that the same tower housing, receptacle means, delivery lines, lower housing and cooling means can be used to provide cooled beverage to a variable number of beverage valves suspended from the tower housing.

23. The beverage dispenser as defined in claim 18, and the receptacle means comprising a plurality of receptacle blocks, each receptacle block having one or more fluid lines secured thereto and one or more connecting means for providing fluid connection to an equal number of beverage line segments.

24. The beverage dispenser as defined in claim 18, and the delivery lines each having an end rigid portion extending from the cooling means and fluidly secured to the receptacle means.

25. The beverage dispenser as defined in claim 18, and one or more of the modules having stop means for cooperating with the connecting means of the receptacle means for preventing fluid flow therethrough from one or more of the delivery lines, and the number of modules and the number of beverage line segments extending through the modules being variable so that the same tower housing, receptacle means, delivery lines, lower housing and cooling means can be used to provide cooled beverage to a variable number of beverage valves suspended from the tower housing.

* * * * *